United States Patent [19]

Marquardt et al.

[11] Patent Number: 4,636,762

[45] Date of Patent: Jan. 13, 1987

[54] CONTACT ASSEMBLY HAVING A CURRENT-DEPENDENT FORCE INCREASING THE CONTACT FORCE

[75] Inventors: Ulrich Marquardt; Ralf Seebold, both of Berlin, Fed. Rep. of Germany

[73] Assignee: Siemens Aktiengesellschaft, Munich and Berlin, Fed. Rep. of Germany

[21] Appl. No.: 770,534

[22] Filed: Aug. 28, 1985

[30] Foreign Application Priority Data

Aug. 28, 1984 [DE] Fed. Rep. of Germany ..... 3432086

[51] Int. Cl.[4] ..... H01H 3/00

[52] U.S. Cl. ..... 335/195; 335/16; 335/147; 200/147 R

[58] Field of Search ..... 335/16, 195, 147, 192, 335/194; 200/147

[56] References Cited

U.S. PATENT DOCUMENTS

| | | | |
|---|---|---|---|
| 1,918,232 | 7/1933 | Baker et al. . | |
| 2,545,341 | 3/1951 | Caswell | 335/16 |
| 2,695,345 | 11/1954 | Scott | 200/89 |
| 2,704,311 | 3/1955 | Thumim | 200/108 |
| 3,550,049 | 12/1970 | Blanc-Tailleur | 335/195 |

FOREIGN PATENT DOCUMENTS

| | | | |
|---|---|---|---|
| 1116782 | 11/1961 | Fed. Rep. of Germany . | |
| 1218594 | 6/1966 | Fed. Rep. of Germany . | |
| 1275255 | 9/1961 | France . | |
| 1388664 | 12/1963 | France | 335/16 |
| 2376506 | 7/1978 | France . | |

*Primary Examiner*—E. A. Goldberg
*Assistant Examiner*—Lincoln Donovan
*Attorney, Agent, or Firm*—F. W. Powers; J. L. James

[57] ABSTRACT

A contact assembly for electrical circuit breakers has a contact lever and a lever support with the contact lever mounted thereon in an articulate fashion. The support lever is flexibly positioned around a fixed pivot bearing by a drive linkage device for on- and off-switching cycles. A pressure lever is used to introduce a current-dependent force onto the contact levers in order to increase the contact force. The pressure lever is similarly flexibly mounted onto the lever support. The contact lever and the pressure lever operate jointly via their working surfaces which permit a conveyance of force in terms of an increase of the contact force. When switching on the contact assembly, the pressure lever is decoupled from the contact lever so that the tendency to bounce is reduced.

10 Claims, 5 Drawing Figures

CONTACT ASSEMBLY HAVING A CURRENT-DEPENDENT FORCE INCREASING THE CONTACT FORCE

BACKGROUND OF THE INVENTION

This invention pertains generally to a contact assembly for an electrical circuit breaker which has a contact lever and a lever support flexibly connected to the contact lever, and more particularly to a lever support which can be swivelled around a fixed bearing by a drive mechanism for on- and off-switching. Such a contact arrangement has a contact spring positioned between the contact lever and the lever support and a circuit-generated current-dependent force can be conveyed to the contact lever to increase the contact force.

A contact assembly of the type described above is disclosed in U.S. Pat. No. 2,704,311. Similar contact assemblies are disclosed in U.S. Pat. Nos. 3,550,049 and 2,695,345 and in German Pats. Nos. 11 16 782 and 12 18 594. In these patents, the current-dependent forces impact one arm of the contact levers which is positioned facing the arm equipped with the movable contact piece. The assembly is based on the fact that the direction of the current-dependent forces is determined by the loop-shaped design of the current circuit. For that purpose, a flexible conductor is frequently utilized, because it is already required to connect a fixed-mounted conductor bus bar to the movable components of the contact assembly. The current-dependent forces are required so that even if large fault currents flow, adequate contact force is ensured until the tripping devices of the circuit breaker provides a switch-off signal.

When switching on these types of contact assemblies, the contact lever is initially shifted into a position largely parallel to itself using its associated lever support until the movable contact piece makes contact with the associated fixed contact piece. The lever support, however, also performs a further motion during which the contact spring is tensioned. This process is linked with a swivelling motion of the contact lever around its fulcrum at the lever support. Is has been observed that during the switch-on cycle the contact lever can bounce around its pivot bearing at the lever support caused by the impact of the contact pieces. This chattering effect is undesirable since it can lead to damage and fusion of the contact pieces. Accordingly, it will be appreciated that it would be highly desirable to provide a contact assembly of the type specified above so that this chatter effect is eliminated during the switch-on cycle.

Existing contact assemblies for low-voltage circuit breakers already incorporate special pressure levers to increase the contact force. These pressure levers are equipped with an armature of a magnetic system excited by the current flowing through the contact assembly. The corresponding yoke of the magnetic system is located at the lever support of the contact assembly. While this assembly does lead to a relatively favorable bouncing action, it is relatively expensive to construct, and, in terms of its attainable compensation force to the current loops, it is not suitable for circuit breakers which are to attain a breaking capacity of approximately 100 kA. See Technical Publication, "Power Engineering II," 8th edition, 1960, pages 53 and 85 of an offprint of the chapter on "Low-Voltage Switchgear."

It is an object of the present invention to provide a contact assembly for a circuit breaker which reduces contact bounce.

Another object of the invention is to provide a contact assembly which prevents fusion of the contact pieces.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
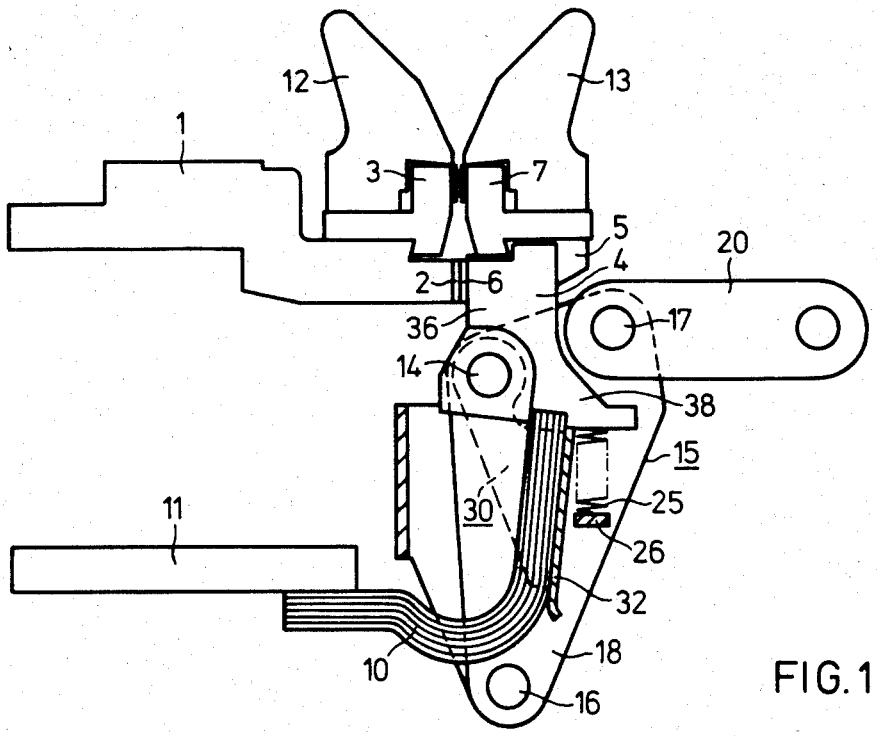
FIG. 1 is a diagrammatic side view of a contact assembly when switched on in accordance with the present invention.
Figure 2:
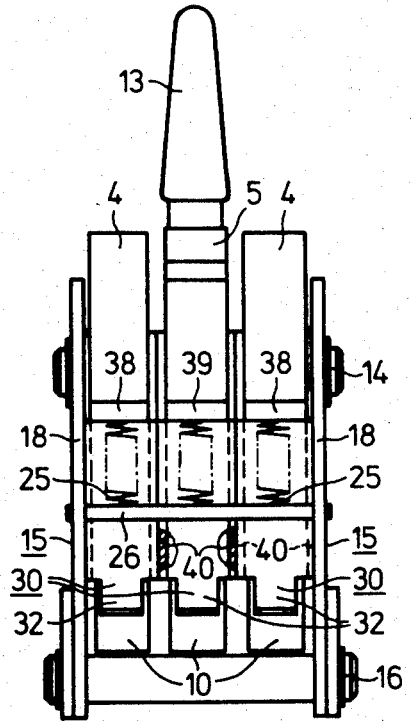
FIG. 2 is a diagrammatic front view illustrating the movable parts of the contact assembly.

FIG. 1 illustrates the main path of the current circuit of a low-voltage circuit breaker. The current circuit includes an upper fixed bus bar 1 with several fixed main contact pieces (FIG. 2) and a fixed arc contact piece as well as contact levers 4 and 5 for the movable main contact pieces 6 and the arc contact piece 7, a flexible conductor 10 for each contact lever, and another fixed bus bar 11. While the fixed main contact pieces 2 are fastened to a frontal side of bus bar 1, the fixed arc contact piece 3 and an associated arcing horn 12 can be disconnected from the bus bar 1. Similarly, the movable main contact pieces 6 form parts of contact lever 4, while the movable arc contact piece 7 and an associated arcing horn 13 can be disconnected from contact lever 5. According to FIG. 2, one contact lever 4 is arranged at each of the two sides of contact lever 5 equipped with the arcing contact piece. An even larger number of contact levers 4 can be incorporated in the design.

Contact levers 4 and 5 are pivot-mounted on a joint bearing pin 14, which in turn is attached to a generally triangular lever support 15. The lever comprises two equal parallel interfacing plates 18 set at a certain distance. The lever support 15 is in turn mounted on a fixed pivot bearing 16 for rotating at its low end. A further joint 17 serves to introduce the force required to switch lever support 15 on or off using a drive linkage 20.

Figure 3:
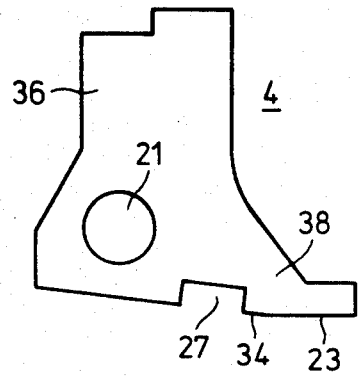
FIG. 3 illustrates the basic configuration of a contact lever.
Figure 4:
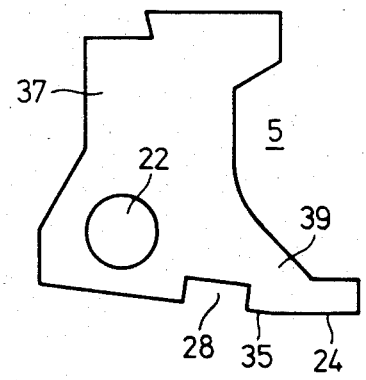
FIG. 4 illustrates an alternate configuration of a contact lever.
Figure 5:
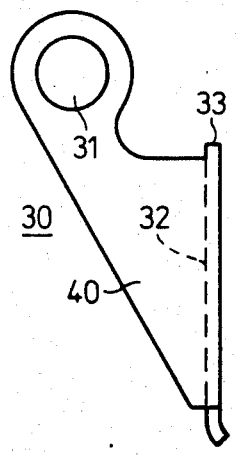
FIG. 5 illustrates a pressure lever.

Referring to FIGS. 3 and 4, the contact levers 4 and 5 are configured in a general boot shape with openings 21 and 22, respectively, which position bearing pin 14 which is located in the area of the boot heel. The vamps or frontal boot parts 38 and 39 in this context serve as the backstop 23, 24 of contact springs 25 which are supported by a backstop 26 of lever support 15. The cutouts 27 and 28 of contact levers 4 and 5 which are connected to the heel of the boot shape serve to fasten the end of the flexible conductor 10. By this construction, the connection point of the flexible conductor 10 is near the bearing openings 21 and 22 so that the current-dependent forces generated in the flexible conductor 10 have only a relatively slight indirect impact on contact levers 4 and 5. The major portion of the forces impact on contact levers 4 and 5 via separate pressure levers 30. One of these pressure levers is shown separately in FIG. 5. Pressure lever 30 also has openings 31 in its parallel arm 40 to handle bearing pin 14 as well as a backstop 32, which supports the flexible conductor 10 along one portion of its length (see FIG. 1). The frontal surface 33 of pressure lever 30 facing the contact levers 4 and 5 is positioned directly beside cutout 27 or 28 between the heel and sole of the bottom side of the boot shape.

Contact levers 4 and 5 are designed as angled levers in terms of their pivot bearing on the swivel pin 14, with the one arm 36 or 37, which could be described as the shaft of the boot, supporting contact pieces 2 or 3. The other, shorter arm 38 or 29 which comprises the frontal portion of the boot shape incorporates cutouts 27 and 28 as fastening points for the current strap as well as the working surfaces 34 or 35 and the backstops 23 or 24. As arms 38 and 39 can be of relatively low mass in design, the new assembly operates substantially better than the known two-arm contact levers with their length extending substantially beyond the joint, thus having a larger tendency to bounce.

In operation in the switched-on position shown, the main contact pieces 2 and 6 make contact under the influence of the contact springs 25. The high currents flowing through the contact assembly effect an increase in the contact force prevailing between the main contact pieces 2 and 6 by having the flexible conductors 10 exert a counter-clockwise torque on pressure lever 30 using their backstops 32. This torque is conveyed over the frontal working surfaces 33 of pressure lever 30 onto the working surfaces 34 and 35 of contact levers 4 and 5. If the switch is then tripped, the interlock of linkage 20 is released and the lever support 15 swivels clockwise around its pivot bearing. By the effect of contact springs 25, a relative motion between the lever support 15 and the contact levers 4 and 5 emerges around their joint bearing pin 14. As a result the main contact pieces 2 and 6 separate so that the current is commuted onto arcing contact pieces 2 and 7. During further motion of lever support 15 around its pivot bearing 16, the arcing contact pieces 3 and 7 also separate in the known fashion forming a switching arc which is conducted over the arcing horns 12 and 13 into an extinguishing device (not shown).

When switching on, the actions proceed correspondingly in reverse sequence, i.e., initially the arcing contact pieces 3 and 7 make contact and only thereafter do the main contact pieces 2 and 6 make contact. The key element in this context is that the pressure levers 30, due to the impact of the contact pieces, can execute a motion independent of the contact levers 4 and 5 around their bearing openings 31 since their frontal surfaces 33 can lift off the working surfaces 34 and 35 of contact levers 4 and 5. In contrast to the previous known contact assemblies with two-arm contact levers, the tendency to bounce is thus significantly reduced. This results in an improved service life and an increased operating reliability of the contact assembly.

It can now be appreciated that there has been presented a contact assembly which eliminates chatter during the switch-on cycle. This is achieved by incorporating a pressure lever which serves to conduct the current-dependent force into the contact lever. The pressure lever is mounted separately from the contact lever on the lever support so that it works in conjunction with the contact lever only to increase the contact force. The contact lever can then be designed with only one arm to handle the impact force arising during the switch-on cycle so that its tendency to oscillate around its bearing located at the lever support is substantially reduced. Any oscillation of the pressure lever around its pivot on the lever arm due to the sudden braking of the moved parts when the contact pieces make contact has no effect on the contact lever since there is only a one-directional coupling connecting the contact lever and the pressure lever.

If, in a contact assembly according to this invention the current-dependent force is generated, as is already known, using a flexible conductor which connects a fixed conductor with the contact lever in a conducting fashion, then the preferred design would have the flexible conductor fastened directly to the contact lever near its fulcrum. The pressure lever for absorbing the current-dependent force would have a backstop for the flexible conductor as well as a working surface which only works in conjunction with a working surface of the contact lever to increase the contact force. Thereby, despite the direct connection of the flexible conductor to the contact lever, the current-dependent forces act on the contact lever largely only due to the action of the pressure lever.

To convey the current-dependent force to the contact lever, the backstop can be designed with a frontal surface which serves as a working surface for the pivot bearing of the pressure lever and works jointly with the working surface of the contact lever.

The lever support can have a joint pivot bearing for the contactlever and a pressure lever. Thus, the new contact assembly can largely be designed without increasing its mass by dividing the contact lever of the existing contact assembly with two arms into two separate single-arm levers.

A preferred embodiment of the invention further provides for the contact lever in terms of its pivot bearing being designed as an angle lever, whose one arm carries a contact piece and whose other shorter arm has a connection point for the flexible conductor and is further equipped with the working surface and a backstop for the contact spring. In this embodiment, the contact lever, when switching on, operates as a single-arm lever with correspondingly favorable bouncing behavior.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A contact assembly for an electrical circuit breaker, comprising: a contact lever, a linkage, a fixed bearing, an articulate lever support which can be swivelled by the linkage around the fixed bearing for on- and off switching, a contact spring mounted between the contact lever and the lever support wherein a circuit-generated current-dependent force is conducted into the contact lever increasing its contact force, and a pressure lever adapted to conduct the current-dependent force into the contact lever, said pressure lever being swivel-mounted onto the lever support independently of the contact lever so that it increases the contact force only in conjunction with the contact lever.

2. A contact assembly in accordance with claim 1, including a flexible conductor generating the current-dependent force and electrically connecting the contact lever with a bus bar, said flexible conductor being fastened in the immediate vicinity of the contact lever near its swivel joint and having the pressure lever incorporate a backstop for the flexible conductor working surface which works in conjunction with a corresponding working surface of the contact lever only to increase the contact force.

3. A contact assembly in accordance with claim 2, wherein the backstop has a frontal surface serving as a working surface on the end positioned closer to the pivot bearing of the pressure lever which frontal surface works in conjunction with the working surfaces of the contact levers.

4. A contact assembly in accordance with claim 1, wherein the lever support has a joint pivot bearing for the contact lever and the pressure lever.

5. A contact assembly in accordance with claim 1, wherein the contact lever is an angle lever with respect to its pivot bearing, said lever having a first arm with a contact piece and a second, shorter arm with a connecting point for the flexible conductor equipped with the working surface and a backstop for the contact spring.

6. A contact assembly for an electrical circuit breaker comprising: a contact lever, a linkage, a fixed bearing, an articulate lever support which can be swivelled by the linkage around the fixed bearing for on- and off switching, a contact spring mounted between the contact lever and the lever support wherein a circuit-generated current-dependent force is conducted into the contact lever increasing its contact force, and a pressure lever adapted to conduct the current-dependent force into the contact lever, said pressure lever being swivel-mounted onto the lever support independently of the contact lever so that it only increases the contact force in conjunction with the contact lever thereby reducing contact bounce during the switch-on stage.

7. A contact assembly in accordance with claim 1, including a flexible conductor generating the current-dependent force and electrically connecting the contact lever with a bus bar, said flexible conductor being fastened in the immediate vicinity of the contact lever near its swivel joint and having the pressure lever incorporate a backstop for the flexible conductor working surface which works in conjunction with a corresponding working surface of the contact lever only to increase the contact force.

8. A contact assembly in accordance with claim 2, wherein the backstop has a frontal surface serving as a working surface on the end positioned closer to the pivot bearing of the pressure lever which frontal surface works in conjunction with the working surfaces of the contact levers.

9. A contact assembly in accordance with claim 1, wherein the lever support has a joint pivot bearing for the contact lever and the pressure lever.

10. A contact assembly in accordance with claim 1, wherein the contact lever is an angle lever with respect to its pivot bearing, said lever having a first arm with a contact piece and a second, shorter arm with a connecting point for the flexible conductor equipped with the working surface and a backstop for the contact spring.

* * * * *